US010272714B2

(12) United States Patent
Swanick

(10) Patent No.: US 10,272,714 B2
(45) Date of Patent: Apr. 30, 2019

(54) ANTI-ROTATION EXTENDABLE ERASER MECHANISM

(71) Applicant: Sanford, L.P., Atlanta, GA (US)

(72) Inventor: Kenneth Swanick, Downers Grove, IL (US)

(73) Assignee: Sanford L.P., Atlanta, GA (US)

( * ) Notice: Subject to any disclaimer, the term of this patent is extended or adjusted under 35 U.S.C. 154(b) by 0 days.

(21) Appl. No.: 15/833,752

(22) Filed: Dec. 6, 2017

(65) Prior Publication Data

US 2018/0154682 A1 Jun. 7, 2018

Related U.S. Application Data

(60) Provisional application No. 62/430,676, filed on Dec. 6, 2016.

(51) Int. Cl.

| | |
|---|---|
| ***B43K 21/22*** | (2006.01) |
| ***B43K 24/08*** | (2006.01) |
| ***B43K 29/02*** | (2006.01) |
| ***B43K 21/027*** | (2006.01) |

(52) U.S. Cl.

CPC ..... *B43K 24/082* (2013.01); *B43K 21/027* (2013.01); *B43K 21/22* (2013.01); *B43K 29/02* (2013.01); *B43K 24/088* (2013.01)

(58) Field of Classification Search

CPC .. A45D 40/04; A45D 40/06; A45D 2040/208; B43K 21/08; B43K 21/085; B43K 21/12; B43L 19/0059; B43L 19/0068; B43L 19/0075; B43L 19/0081

USPC ..... 15/429, 433; 401/74

See application file for complete search history.

(56) References Cited

U.S. PATENT DOCUMENTS

| | | | |
|---|---|---|---|
| 2,286,878 | A | 6/1942 | Tefft et al. |
| 2,337,979 | A | 12/1943 | Dorner |
| 4,904,101 | A | 2/1990 | Petterson |
| 5,018,891 | A | 5/1991 | Kageyama et al. |
| 5,927,882 | A | 7/1999 | Kageyama |
| 5,988,914 | A | 11/1999 | Kageyama et al. |
| 6,893,179 | B2 | 5/2005 | Kageyama et al. |
| 7,284,927 | B2 | 10/2007 | Kageyama |
| 8,734,040 | B2 | 5/2014 | Roberts et al. |
| 8,905,665 | B2 | 12/2014 | Chang |
| 8,915,663 | B2 | 12/2014 | Rolion et al. |
| 9,199,045 | B2 | 12/2015 | Banik |

(Continued)

FOREIGN PATENT DOCUMENTS

| | | |
|---|---|---|
| CN | 2604327 Y | 2/2004 |
| CN | 2691873 Y | 4/2005 |

(Continued)

OTHER PUBLICATIONS

International Search Report and Written Opinion for PCT/US2018/019434, dated Sep. 26, 2018 (18 pages).

*Primary Examiner* — David P Angwin
*Assistant Examiner* — Bradley S Oliver
(74) *Attorney, Agent, or Firm* — Eversheds Sutherland (US) LLP

(57) ABSTRACT

An anti-rotation mechanism for a retractable eraser or other stick-like object for use with a writing instrument that utilizes locking elements to prevent the inadvertent retraction or extension of the eraser when pressure is applied to the eraser during the erasing operation.

19 Claims, 7 Drawing Sheets

(56) References Cited

U.S. PATENT DOCUMENTS

| | | | | |
|---|---|---|---|---|
| 2004/0221422 | A1* | 11/2004 | Aiguo | B43K 29/02 15/426 |
| 2014/0003855 | A1 | 1/2014 | Chang | |
| 2015/0063893 | A1 | 3/2015 | Oomoto et al. | |

FOREIGN PATENT DOCUMENTS

| | | | |
|---|---|---|---|
| CN | 1919618 | A | 2/2007 |
| CN | 201511687 | U | 6/2010 |
| CN | 204136633 | U | 2/2015 |
| DE | 1289458 | B | 2/1969 |
| EP | 0850784 | A2 | 7/1998 |
| JP | 10109498 | | 4/1998 |
| KR | 2001-0075812 | A | 8/2001 |

* cited by examiner

ANTI-ROTATION EXTENDABLE ERASER MECHANISM

CROSS REFERENCE TO RELATED APPLICATIONS

This application claims priority benefit of U.S. Provisional Application No. 62/430,676, titled "Writing Instrument" and filed on Dec. 6, 2016, which is incorporated herein by reference.

FIELD OF THE DISCLOSURE

This disclosure generally relates to writing instruments, and more specifically relates to an anti-rotation extendable/retractable eraser mechanism for use with writing instruments.

BACKGROUND

Writing instruments, and specifically pencils, have been in widespread use for hundreds of years, with mechanical pencils dating as far back as the 18th century. The first eraser was mounted on the end of a pencil in the late 1800s and by the 1920s, almost all of the pencils sold in America included erasers. Over that time, various iterations of stand-alone, removable, and integrated erasers have been developed for use with various pencils and other writing instruments. Notably, mechanical pencils adopted the use of extendable erasers, to increase the volume of eraser available with each writing instrument, and to allow for the use of user-replaceable erasers. A number of actuation or actuation mechanisms for exposing the eraser are known in the art.

One common method of actuating an eraser from an end of a writing instrument is a twist-type actuation mechanism in which the user twists a rotating knob in one direction to extend the eraser from the eraser end of the writing instrument, and twists the knob in the opposite direction to withdraw the eraser back into the eraser end. Conventional twist-to-extend mechanisms generally allow for the free rotation of the eraser knob in either direction. When the eraser is used, pressure is applied to the writing instrument to create the friction needed between the writing instrument, eraser, and the writing substrate to allow the eraser to erase marks from the substrate. These extendable erasers are frequently prone to unintended retraction, specifically, when the extended eraser is used, the applied pressure can cause the actuation mechanism to rotate and result in the retraction of the eraser. Alternatively, it may result in inadvertent extension of the eraser, which can lead to breakage of the eraser if it is over extended. Both conditions are undesirable and disadvantageously interrupt the erasing operation.

Accordingly, a need exists to create a simple, reliable, eraser retraction and actuation mechanism that overcomes the one or more of the disadvantages of current designs.

SUMMARY OF THE DISCLOSURE

In accordance with one embodiment of the disclosure, an eraser mechanism includes a body, the body being generally tubular in shape with a central bore, a first body end and a second body end opposite the first body end, as well an eraser actuation mechanism, configured to extend and retract an eraser, and a knob. The knob is generally tubular in shape, and has a generally tubular sleeve protruding coaxially from a first knob end, the sleeve being disposed in a central bore of the body and cooperatively linking the actuation mechanism to the knob. The knob also includes a first locking element, and the body comprises a second locking element, the locking elements being adapted to selectively prevent the rotation of the knob with respect to the body. The locking elements act as a clutch system for the rotatable components of the eraser mechanism, when pressure is applied to the eraser during use, the locking elements engage, preventing or resisting rotation, but when flipped and the pressure is released, the components rotate freely.

In another embodiment of the disclosure, a writing instrument includes an outer sleeve having a first end and an oppositely disposed second end, a central bore extending between the first and second ends, a stick-like object, and a stick-like object actuation mechanism at least partially received in the central bore. The writing instrument also includes a rotating structure that is adapted to be rotated by a user, where at least a portion of the rotating structure extends outwardly from the second end of the outer sleeve and has a surface that is adjacent to the second end of the outer sleeve, that surface including a first locking element, and the second end of the outer sleeve includes a second locking element that cooperates with the first locking element to prevent rotation of the rotating structure when a force is applied to the stick like object.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
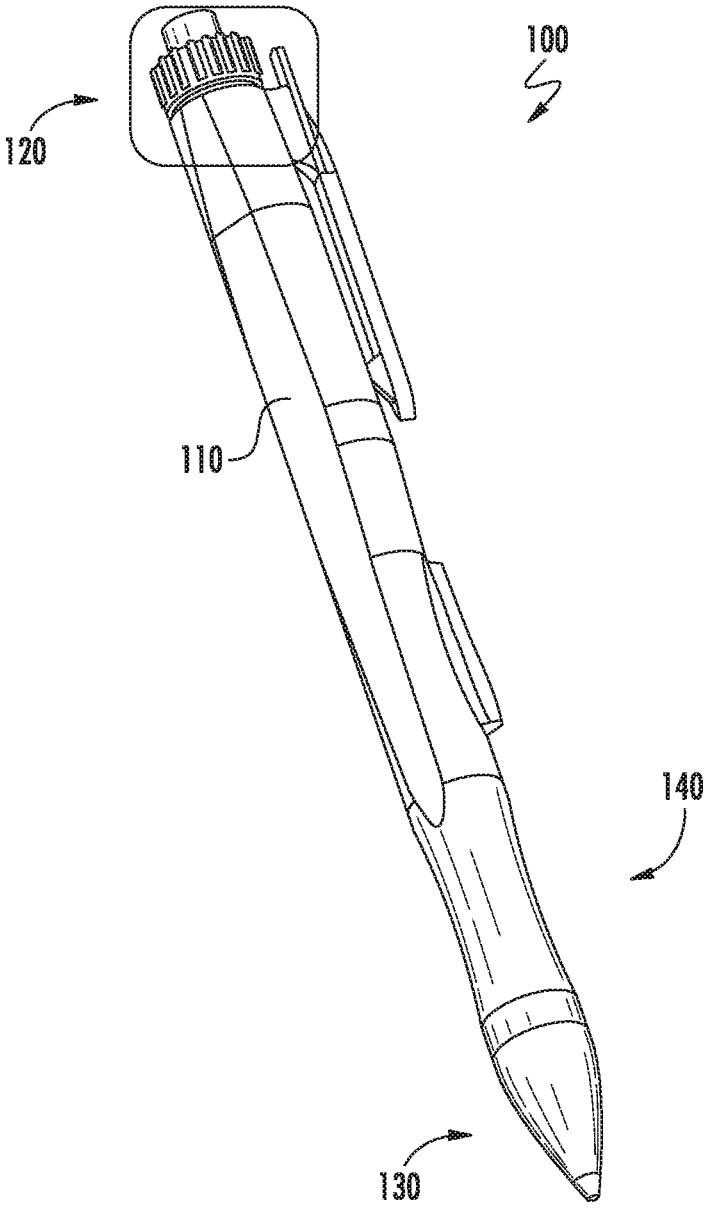
FIG. 1 is a perspective view of a writing instrument in accordance with one example embodiment of the present disclosure.

The writing instruments and eraser mechanisms described herein advantageously can accommodate various writing and erasing mediums. The present disclosure includes non-limiting embodiments of writing instruments and anti-rotation extendable eraser mechanisms referred to generally herein as "writing instruments" and "eraser mechanisms" respectively. The embodiments are described in detail herein to enable one of ordinary skill in the art to practice the writing instruments and associated eraser mechanisms, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

The meanings of the terms used herein will be apparent to one of ordinary skill in the art or will become apparent to one of ordinary skill in the art upon review of the detailed description when taken in conjunction with the several drawings and the appended claims. While certain discussion is made herein with respect to an eraser, it should be understood that the present disclosure could be used with other stick-like objects within the scope of the present disclosure, such as a piece of chalk or other writing medium. As used herein, the terms "connect," "mount," "couple," and other similar terms are used broadly to refer to any suitable direct or indirect connection mechanism. Reference to a "generally tubular" shape herein refers to a hollow cylinder with a generally circular cross section, although other cross-sections could be used within the scope of the present disclosure.

Throughout this disclosure, various aspects of this disclosure are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

FIG. 1 illustrates a writing instrument 100 in accordance with one or more embodiments of the disclosure. The writing instrument 100 includes a barrel 110 that may be generally tubular in shape, with an eraser end 120, a writing end 130 opposite the eraser end, and a gripping region 140 therebetween. The eraser end 120 includes an eraser mechanism 200 for extending and retracting an eraser 203 as described more fully below. While the eraser mechanism is shown attached to or integrated with a mechanical pencil herein, it is also contemplated that the eraser mechanism may be adapted for attachment to an existing wooden pencil or other preexisting writing instrument.

Figure 2:
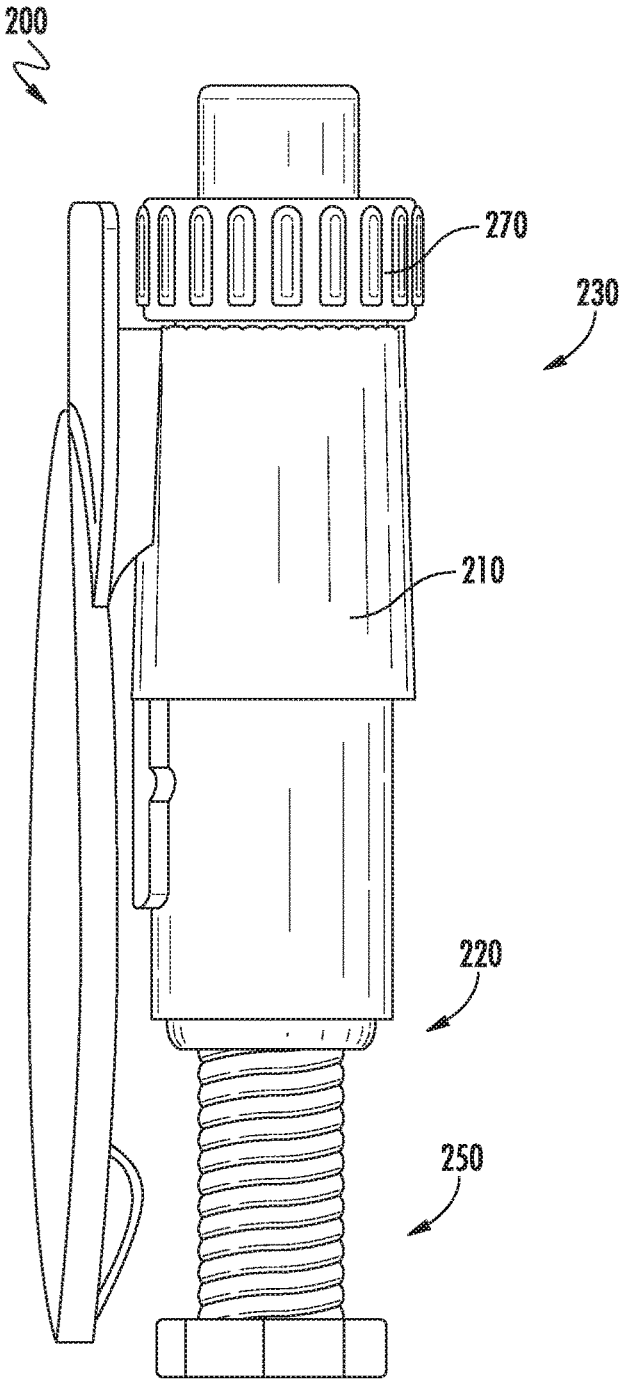
FIG. 2 is a side view of an anti-rotation eraser mechanism subassembly in accordance with one example embodiment of the present disclosure.
Figure 3:
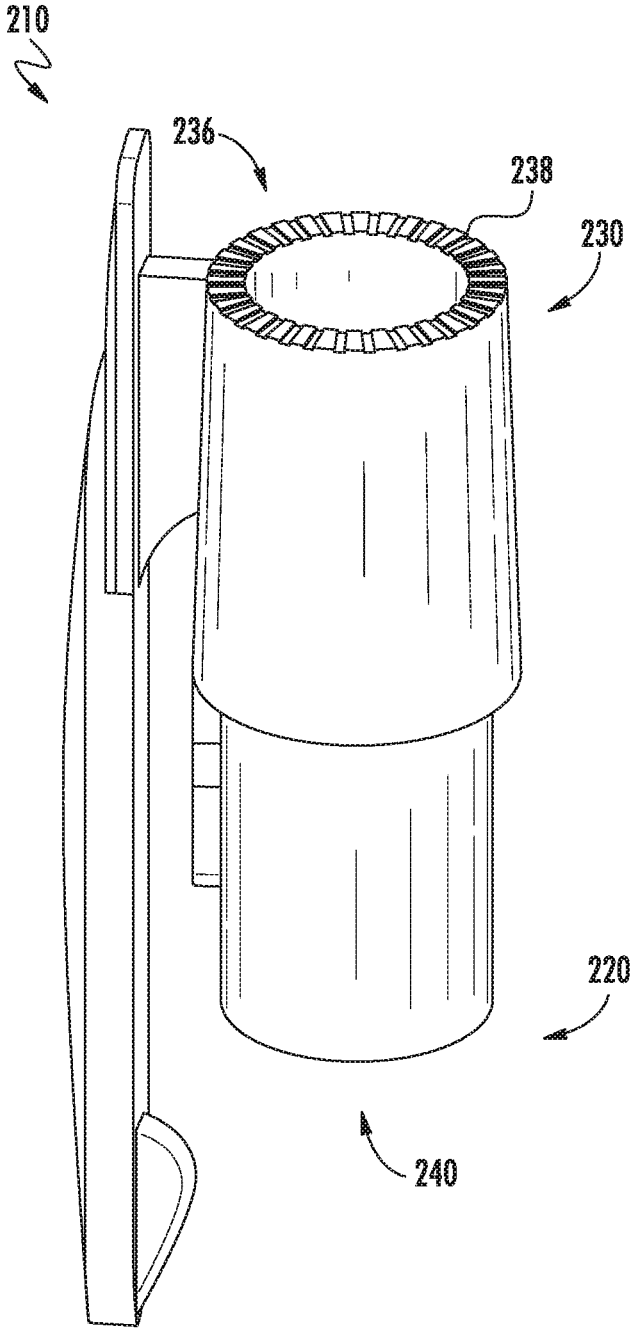
FIG. 3 is a perspective view of a body of the eraser mechanism of FIG. 2.

FIG. 2 illustrates an eraser mechanism 200 in accordance with one or more embodiments of the disclosure. The eraser mechanism 200 may include a body 210, the body 210 being generally tubular in shape and comprising a first body end 220, a second body end 230, and a body central bore 240. In some embodiments, the body 210 of the eraser mechanism 200 may be disposed on or otherwise mounted on the eraser end 120 of the barrel 110 of the writing instrument 100, while in other embodiments, the body 210 may be integrally formed with the barrel 110 of the writing instrument 100. As explained in more detail below, the eraser mechanism may include an actuation mechanism 250 that allows an eraser to be selectively extended out the barrel 110 of the writing instrument 100, exposing it for use, and retracted within the barrel for storage. Any known eraser actuation mechanism that utilizes user rotation to extend the eraser can be used in accordance with the current disclosure. For example, in one embodiment, the actuation mechanism is a two-stage screw mechanism such as described in U.S. Patent Application No. 2004/0221422, the disclosure of which is incorporated herein by reference.

As shown in FIG. 2, the eraser mechanism may also include a knob 270. Eraser actuation mechanisms that rely on a twisting motion generally include a structure, such as a knob, that is rotated by the user in order to extend or retract the eraser into or out of the writing instrument. In these embodiments, for example, the knob 270 can be rotated clockwise to extend the eraser out of the barrel 110, and in the opposite direction, to retract the eraser. The knob 270 may be generally tubular in shape and include a first knob end 272 and a second knob end 273. The knob 270 may also include a sleeve 274 that is generally tubular in shape and protrudes from the first knob end 272 coaxially along a longitudinal axis of the knob 270. The sleeve may be disposed in the body central bore 240 and be adapted to cooperatively link the actuation mechanism 250 to the knob 270.

Figure 4:
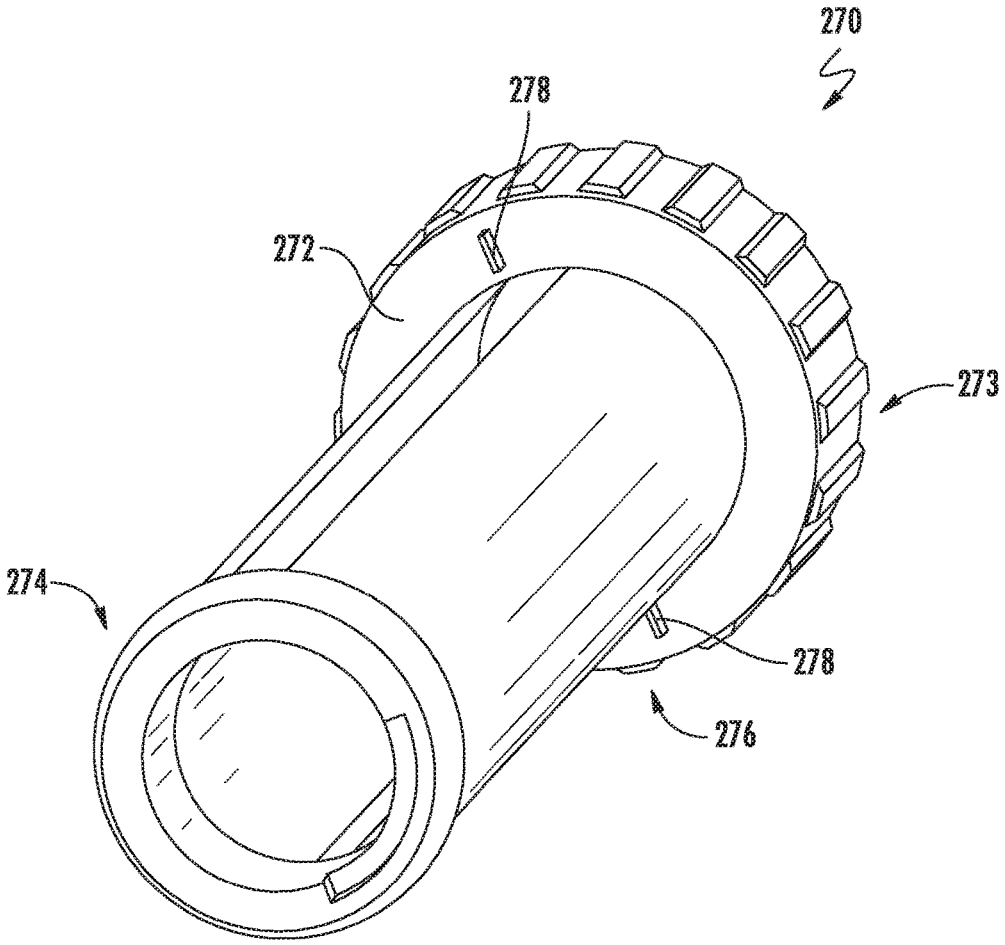
FIG. 4 is a perspective view of a knob of the eraser mechanism of FIG. 2.
Figure 5:
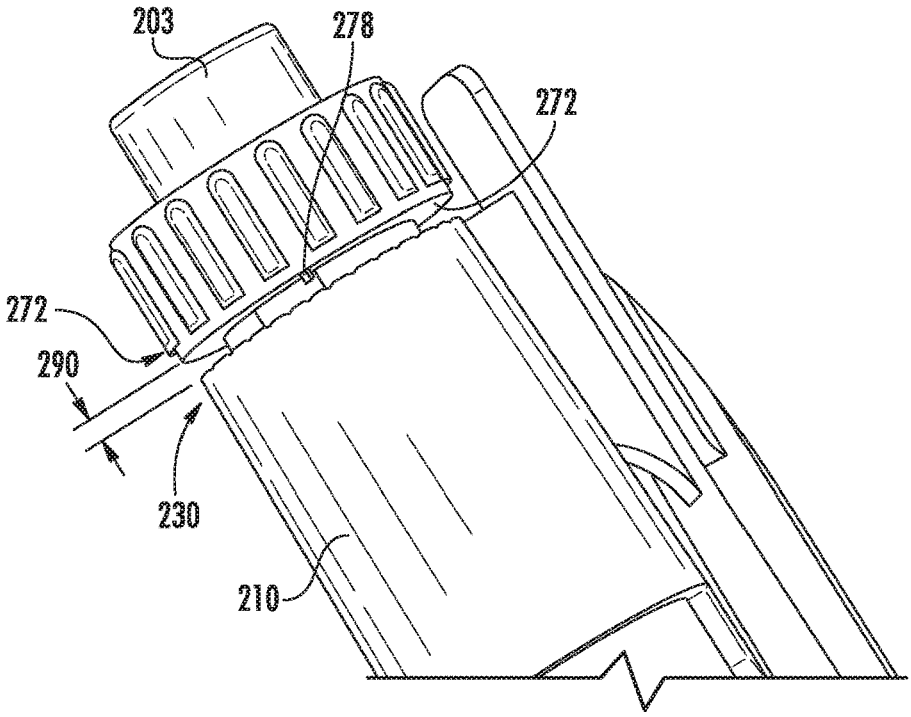
FIG. 5 is a magnified view of the eraser end of the writing assembly of FIG. 1.

As shown in FIG. 4, in some embodiments, the first knob end 272 includes a first locking element 276. As shown in FIG. 5, in some embodiments, the second body end 230 comprises a second locking element 236. These locking elements are adapted to selectively prevent the rotation of the knob 270 with respect to the body 210 when pressure is applied to the eraser end 120 during the erasing operation. It should be understood herein that the locking elements can be disposed on any surface of the barrel 110 or other structure that houses the eraser actuation mechanism 250 that is adjacent to the knob 270 to achieve the same effect. By preventing or resisting the inadvertent rotation of the knob 270, eraser retraction or extension is eliminated or at least greatly reduced.

Figure 6:
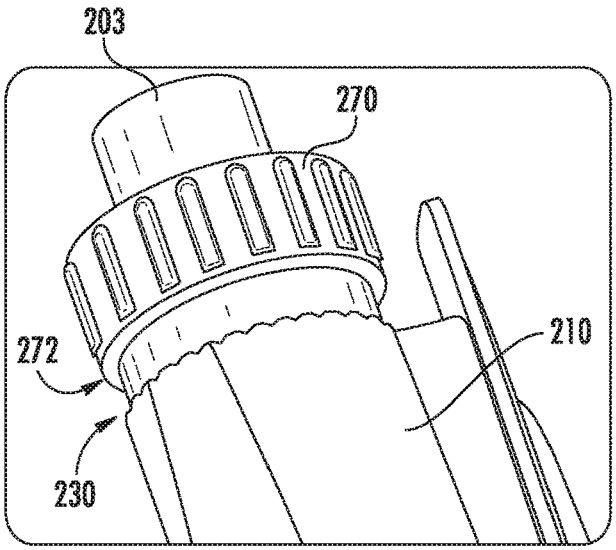
FIG. 6 is a magnified view of the eraser end of the writing assembly of FIG. 1, with a force applied thereto.

As shown in FIG. 5, the eraser mechanism 200 may include a gap 290 between the second body end 230 and the first knob end 272 when the writing instrument 100 is at rest. In some embodiments, the application of a pressing force reduces the gap 290 such that the first locking element 276 and the second locking element 236 are brought into engagement, preventing or resisting rotation of the knob 270, as illustrated in FIG. 6. When no force is applied, the gap allows the knob to rotate without interference from the locking elements. In some exemplary embodiments, the gap 290 has a distance, measured between the first knob end 272 and the second body end 230, of about 0.004 inches to about 0.015 inches, about 0.004 inches to about 0.012 inches, or about 0.008 inches to about 0.010 inches. Other suitable gap distances include about 0.004, 0.005, 0.006, 0.007, 0.008, 0.009, 0.010, 0.011, 0.012, 0.013, 0.014, and 0.015 inches.

As illustrated in FIG. 5, in some embodiments the first locking element 276 includes at least one protrusion 278 that extends axially outwardly from the first knob end 272. As illustrated in FIG. 4, in some embodiments, the second locking element 236 includes at least one groove 238 extending axially inward from the second body end 230, where the groove 238 is configured to receive the protrusion 278 when a pressing force is applied and the components are aligned. In one exemplary embodiment, the second body end 230 includes a series of grooves 238 disposed evenly around the circumference of the second body end 230 and sized to receive one or more protrusions 278. By increasing the number of grooves 238, there is greater flexibility allowed in the alignment of the locking elements. That is, less rotation of the knob 270 is required to align a protrusion 278 with a groove 238 allowing the locking elements engage each other and prevent rotation of the knob 270. By increasing the density of the grooves, the rotation can be minimized so that it is negligible or imperceptible to the user. In some embodiments, the second locking element 236 may have between 1 and 48 grooves, where the number of grooves can be selected such that the grooves cover the entire circumference of the respective surface at a desired spacing.

Similarly, in some exemple embodiments, the first knob end 272 may comprise a series of protrusions 278 disposed evenly around the circumference of the first knob end 272. In one embodiment, the first locking element 276 may comprise two protrusions 278, spaced about 180 degrees apart from each other around the circumference of the first knob end 272. In other exemplary embodiments, the first locking element may have between 1 and 48 protrusions 278, so long as the number of protrusions 278 is equal to or less than the number of grooves 238. As with the grooves 238 of the second locking element 236, increasing the density of the first locking element 276 protrusions 278 reduces the rotation required to align up the protrusions 278 with an associated groove 238 for engagement of the locking elements. In one embodiment, the number of protrusions 278 is selected such that the angle between one protrusion 278 and the next protrusion 278 is the same or a multiple of the angle between one groove 238 and the next groove 238. That is, if "g" is the angle between adjacent grooves 238 in the second locking element 236, and "p" is the angle between adjacent protrusions 278 in the first locking element, then gA=p, where A is a positive integer.

In various embodiments, the grooves 238 can have a width substantially the same as the width of the protrusions 278. Alternatively, the spaced grooves 238 can have a width larger than the width of the protrusions 278. The grooves 238 can be spaced any desired distance. For example, the space between the grooves 238 can have a width substantially the same as or less than the width of the protrusions 278. While FIGS. 4 and 5 illustrate the protrusions 278 being disposed on the knob 270 and the grooves 238 disposed on the body 210, it is also contemplated herein that the arrangement can be reversed with the protrusions 278 extending from the second body end 230 and the grooves 238 being disposed on the first knob end 272.

Where grooves 238 and protrusions 278 are used as the locking elements, they can have the same or different cross-sectional shapes so long as when engaged together, rotation of the knob 270 is resisted or prevented. For example, the grooves 238 may have a triangular cross-sectional shape. In other embodiments, the grooves 238 may have a semi-circular cross-sectional shape. Similarly, the protrusions 278 may have any cross-sectional shape so long as they can be received by the grooves 238. In some examples, the protrusions 278 have a triangular cross-sectional shape. In other examples, the protrusions 278 have a semi-circular cross-sectional shape.

Other interacting, mating, or cooperating structures can be used as the first locking element 276 and the second locking element 236. For example, both the second body end 230 and the first knob end 272 can include a series of grooves around the circumference of portion of the circumference of the respective surface. This results in a series of raised portions between adjacent grooves. Raised portions of the first knob end 272 can interact with the grooves on the second body end 230 to resist or prevent rotation and vice versa.

Figure 7:
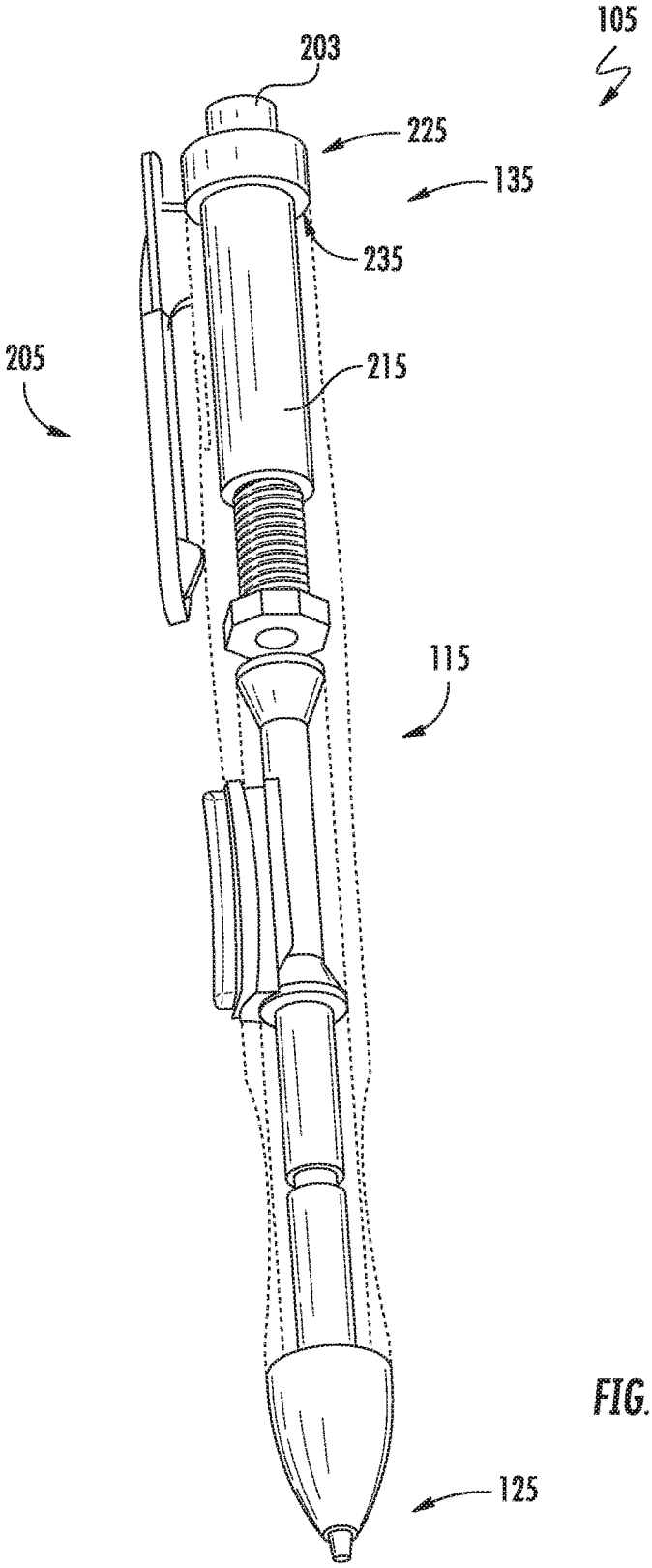
FIG. 7 is a transparent side view illustrating the internal components of a writing instrument in accordance with one example embodiment of the present disclosure.

FIG. 7 illustrates one example writing instrument 100 with a translucent barrel 110, showing its internal components and showing the eraser mechanism 200. In another example embodiment, as shown in FIG. 7, the writing instrument 105 includes an outer sleeve 115 having a first end 125, an oppositely disposed second end 135, and a central bore 145 (not labeled) extending between the first and second ends. The writing instrument 100 also includes a stick-like object 203 and a stick-like object actuation mechanism 205, where the stick-like object actuation mechanism 205 is at least partially received in the central bore 145. The stick-like object actuation mechanism 205 may include a rotating structure 215 adapted to be rotated by a user. A portion (225) of the rotating structure may extend outwardly from the first end 125 of the outer sleeve 115 and have a surface 235 that is adjacent to the first end 125 of the outer sleeve 115. The surface 235 may include a locking element and the first end 125 of the outer sleeve 115 may include a second locking element that cooperates with the first locking element to prevent or resist rotation of the rotating structure 215 when a pressing force is applied to the stick-like object 203. In some exemplary embodiments the stick-like object 203 is an eraser, while in other embodiments it may be a writing medium such as chalk or pencil lead.

Figure 8:
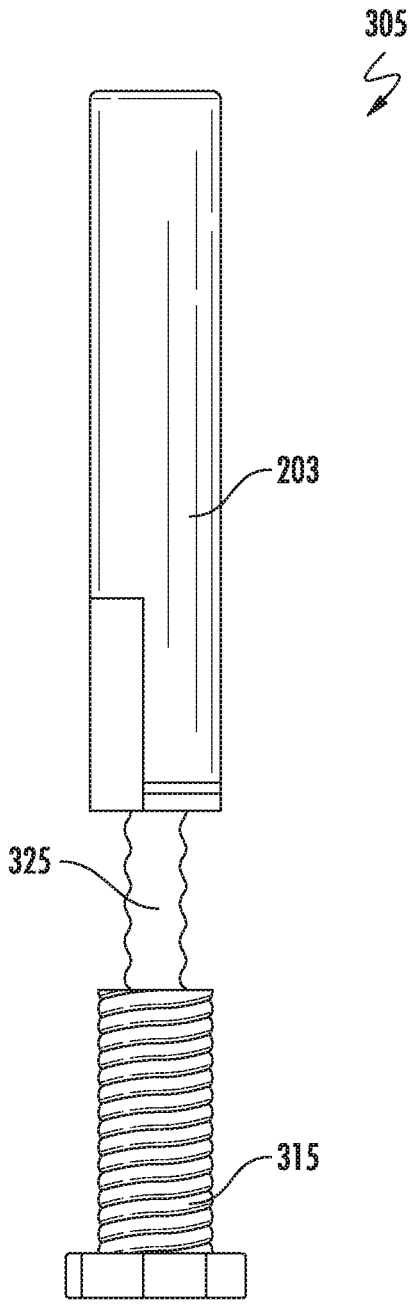
FIG. 8 is a side view of a two-stage screw mechanism in accordance with one example embodiment of the present disclosure.

As shown in FIG. 8, in one example embodiment, the stick-like object actuation mechanism 205 comprises a two-stage screw mechanism 305. The two-stage screw mechanism 305 may include a first screw element 315, that has external threads and is disposed in the outer sleeve 115 and a second screw element 325, nested within the first screw 315 and cooperatively connecting the first screw 315 and the stick-like object 203. In one example, the rotating structure 215 is adapted to drive rotation of the second screw 325, which cooperates with the first screw 315 to create axial movement of the stick-like object.

In yet another example embodiment, a writing instrument 100 includes a tubular barrel 110 with a writing end 130, an eraser end 120 and a central bore extending therebetween. The writing instrument 100 may also include an eraser mechanism 200, partially disposed in the central bore of the barrel 110 at the eraser end 120, that includes a knob 270, extending beyond the eraser end 120 of the barrel 110 for grasping by a user. The knob 270 may include a first knob end 272, adjacent to the eraser end 120 of the barrel 110. The eraser mechanism 200 may also include an actuation mechanism 250, disposed in the central bore of the barrel 110, and a sleeve 274, cooperatively linking the knob 270 and the actuation mechanism 250. The eraser end 120 of the barrel 110 and the first knob end 272 each may also include locking elements to selectively prevent the rotation of the eraser mechanism 200 with respect to the barrel 110 when a pressure is applied.

In some embodiments, the actuation mechanism 250 is configured to removably mount an eraser. In some embodiments the eraser is permanently mounted. The locking elements may include a plurality of mating grooves 238 and protrusions 278. In one example embodiment, the locking elements on the first knob end 272 of the knob 270 include at least one protrusion, while the locking elements on the eraser end 120 of the barrel 110 include a plurality of grooves 238 adapted to receive the protrusions 278 on the first knob end 272 of the knob 270.

EXAMPLE

Comparative testing, measuring the retraction of the eraser resulting from the same use shows the improvements achieved by the present disclosure over existing designs.

The tables below show the results of comparison testing performed by extending the eraser a consistent distance, measuring the extension, and then using eraser by applying a specified number of strokes at a predetermined angle.

TABLE 1

Retraction Testing - Current Designs

| Sample | Initial Extension (mm) | Final Extension (mm) | Retraction (mm) | Retraction (%) |
|---|---|---|---|---|
| 1 | 5 | 1.93 | 3.07 | 61.4 |
| 2 | 5 | 1.48 | 3.52 | 70.4 |
| 3 | 5 | 1.8 | 3.2 | 64 |
| 4 | 5 | 2.06 | 2.94 | 58.8 |
| 5 | 5 | 1.78 | 3.22 | 64.4 |
| 6 | 5 | 2.77 | 2.23 | 44.6 |
| 7 | 5 | 1.91 | 3.09 | 61.8 |
| 8 | 5 | 1.99 | 3.01 | 60.2 |
| 9 | 5 | 1.96 | 3.04 | 60.8 |
| 10 | 5 | 1.48 | 3.52 | 70.4 |
| 11 | 5 | 1.54 | 3.46 | 69.2 |
| 12 | 5 | 2.02 | 2.98 | 59.6 |
| 13 | 5 | 1.93 | 3.07 | 61.4 |
| 14 | 5 | 1.77 | 3.23 | 64.6 |
| 15 | 5 | 1.65 | 3.35 | 67 |
| 16 | 5 | 1.71 | 3.29 | 65.8 |
| 17 | 5 | 1.58 | 3.42 | 68.4 |
| 18 | 5 | 1.57 | 3.43 | 68.6 |
| 19 | 5 | 2.01 | 2.99 | 59.8 |
| 20 | 5 | 1.79 | 3.21 | 64.2 |
| | | | Average % | 63.27 |

As shown above, the existing design showed an average retraction of more than 63%. The same testing was performed on the instant disclosure.

TABLE 2

Retraction Testing - Instant Disclosure

| Sample | Initial Extension (mm) | Final Extension (mm) | Retraction (mm) | Retraction (%) |
|---|---|---|---|---|
| 1 | 5 | 4.61 | 0.39 | 7.8 |
| 2 | 5 | 4.45 | 0.55 | 11 |
| 3 | 5 | 4.97 | 0.03 | 0.6 |
| 4 | 5 | 4.19 | 0.81 | 16.2 |
| 5 | 5 | 4.83 | 0.17 | 3.4 |
| 6 | 5 | 4.21 | 0.79 | 15.8 |
| 7 | 5 | 4.81 | 0.19 | 3.8 |
| 8 | 5 | 4.84 | .016 | 3.2 |
| 9 | 5 | 4.71 | 0.29 | 5.8 |
| 10 | 5 | 4.55 | 0.45 | 9 |
| 11 | 5 | 4.72 | 0.28 | 5.6 |
| 12 | 5 | 3.98 | 1.02 | 20.4 |
| 13 | 5 | 5 | 0 | 0 |
| 14 | 5 | 3.31 | 1.69 | 33.8 |
| 15 | 5 | 4.56 | 0.44 | 8.8 |
| 16 | 5 | 4.83 | 0.17 | 3.4 |
| 17 | 5 | 4.29 | 0.71 | 14.2 |
| 18 | 5 | 4.85 | 0.15 | 3 |
| 19 | 5 | 4.59 | 0.41 | 8.2 |
| 20 | 5 | 4.49 | 0.51 | 10.2 |
| | | | Average % | 9.21 |

The instant disclosure show greatly improved performance, with a measured retraction of less than 10 percent.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific mechanisms and configurations, it will be appreciated that numerous other mechanisms and configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. An eraser mechanism comprising:

a body, the body being generally tubular in shape and comprising a first body end, a second body end opposite the first body end, and a body central bore;

an actuation mechanism configured to extend and retract an eraser; and a knob, the knob being generally tubular in shape and comprising a first knob end, a second knob end opposite the first knob end, and a sleeve, the sleeve being generally tubular in shape and protruding from the first knob end coaxially along a longitudinal axis of the knob;

wherein the sleeve is disposed in the body central bore and cooperatively links the actuation mechanism to the knob;

wherein the first knob end comprises a first locking element comprising at least one protrusion outwardly extending from the first knob end, and the second body end comprises a second locking element comprising a series of grooves extending inwardly from the second body end and disposed evenly around a circumference of the second body end, wherein the series of grooves are configured to receive the at least one protrusion when a pressing force is applied to the eraser and are adapted to selectively prevent the rotation of the knob with respect to the body.

2. The eraser mechanism of claim 1, wherein a gap is present between the second body end and the first knob end, such that application of a pressing force to the eraser reduces the gap such that the at least one protrusion and the series of grooves are brought into engagement.

3. The eraser mechanism of claim 2, wherein the gap has a distance of about 0.004 inches to about 0.012 inches.

4. The eraser mechanism of claim 1, wherein the at least one protrusion comprises between 1 and 48 protrusions.

5. The eraser mechanism of claim 1, wherein the grooves in the series of grooves outnumber the protrusions.

6. The eraser mechanism of claim 1, wherein the series of grooves comprises between 2 and 48 grooves.

7. The eraser mechanism of claim 1, wherein the first knob end comprises a series of protrusions disposed evenly around a circumference of the first knob end.

8. The eraser mechanism of claim 1, at least one protrusion comprises a first protrusion and a second protrusion, spaced about 180 degrees apart from each other around a circumference of the first knob end.

9. The eraser mechanism of claim 1, wherein the at least one protrusion has a triangular cross-sectional shape.

10. The eraser mechanism of claim 1, wherein the at least one protrusion has a semi-circular cross-sectional shape.

11. The eraser mechanism of claim 1, wherein the at least one protrusion and the grooves of the series of grooves comprise generally the same cross-sectional shape.

12. A writing instrument comprising:

an outer sleeve having a first end, an oppositely disposed second end, and a central bore extending between the first and second ends;

a stick-like object; and a stick-like object actuation mechanism at least partially received in the central bore, the stick-like object actuation mechanism comprising a rotating structure adapted to be rotated by a user, wherein a portion of the rotating structure extends outwardly from the second end of the outer sleeve and has a surface that is adjacent to the second end of the outer sleeve, wherein the surface comprises a first locking element comprising at least one protrusion outwardly extending from the surface and the second end of the outer sleeve comprises a second locking element comprising a series of grooves extending inwardly from the second end of the outer sleeve and disposed evenly around a circumference of the second end of the outer sleeve, wherein the series of grooves are configured to cooperate with the at least one protusion to prevent rotation of the rotating structure when a pressing force is applied to the stick-like object.

13. The writing instrument of claim 12, wherein the stick-like object is an eraser.

14. The writing instrument of claim 12, wherein the stick-like actuation mechanism comprises a two-stage screw mechanism.

15. The writing instrument of claim 14, wherein the two-stage screw mechanism comprises:

a first screw element, disposed in the outer sleeve and having external threads;

a second screw element, nested within the first screw element and cooperatively connecting the first screw element and the stick-like object; and wherein the rotating structure is adapted to drive rotation of the second screw element which cooperates with the first screw to create axial movement of the stick-like object.

16. A writing instrument comprising:

a tubular barrel having a writing end, an eraser end, and a central bore extending therebetween; and an eraser mechanism, partially disposed in the central bore at the erasing end of the barrel and comprising:

a knob, extending beyond the eraser end of the barrel for grasping by a user and comprising a first knob end, adjacent to the eraser end of the barrel;

an actuation mechanism, disposed in the central bore of the barrel and configured to removably mount an eraser; and a sleeve, cooperatively linking the knob and the actuation mechanism;

wherein the eraser end of the barrel and the first knob end each further comprise locking elements comprising a plurality of mating grooves and at least one protrusion configured to cooperate to selectively prevent the rotation of the eraser mechanism with respect to the barrel when a pressure is applied to the eraser.

17. The writing instrument of claim 16, wherein the grooves of the plurality of mating grooves outnumber the at least protrusion.

18. The writing instrument of claim 16, wherein the first knob end of the knob comprises the at least one protrusion, which comprises between 1 and 48 protrusions.

19. The writing instrument of claim 16, wherein the plurality of grooves are configured to receive the at least one protrusion on the first knob end of the knob.

* * * * *